United States Patent [19]

Yoshie et al.

[11] Patent Number: 4,993,616

[45] Date of Patent: Feb. 19, 1991

[54] ELECTRIC STAPLER CARTRIDGE

[75] Inventors: Toru Yoshie; Yuji Sakurazawa; Mitsuteru Kurosawa, all of Tokyo, Japan

[73] Assignee: Max Co., Ltd., Nihonbashi, Japan

[21] Appl. No.: 425,691

[22] Filed: Oct. 24, 1989

[30] Foreign Application Priority Data

Oct. 25, 1988 [JP] Japan ..... 63-138693[U]
Apr. 4, 1989 [JP] Japan ..... 64-39801[U]

[51] Int. Cl.[5] ..... B27F 7/21
[52] U.S. Cl. ..... 227/120; 227/131
[58] Field of Search ..... 227/120, 131

[56] References Cited

U.S. PATENT DOCUMENTS 3,622,061 11/1971 Penfield .
4,623,082 11/1918 Kurosawa .
4,650,105 3/1987 Yoshio .

FOREIGN PATENT DOCUMENTS 0127853 5/1984 European Pat. Off. .

*Primary Examiner*—Paul A. Bell
*Attorney, Agent, or Firm*—Cushman, Darby & Cushman

[57] ABSTRACT

The present invention is an improvement in a staple sheet cartridge for an automatic stapler where sheets of staples are delivered to the forming and driving section of the stapler by a conveyor belt. A retaining protrusion is formed on a guide member such that contact area of, and perpendicular force on the staple sheet are maximized without auxiliary magnetic means, allowing smooth, positive and consistent delivery of the staple sheets to the forming and driving section of the stapler.

6 Claims, 3 Drawing Sheets

ELECTRIC STAPLER CARTRIDGE

BACKGROUND OF THE INVENTION

1. Field Of The Invention

This invention relates to stapling machines, hereinafter called staplers, and more particularly to improvements of a staple cartridge for a stapler in which a number of staple sheets are stacked and delivered by a conveying belt to the forming and driving section thereof. Such staple blanks sheets are formed by bonding a plurality of straight wire staples blanks together in the form of a sheet.

2. Description Of Related Art

In the prior art staples are successfully supplied with a pawl to the forming and driving section. In such a stapler the staples are formed into a roll using a piece of tape as well as an adhesive. This double adhesive is necessary in order to reliably hold the staples together into the roll. The roll is then loaded into a cartridge and thus is fed into the stapler. The disadvantages of this system are twofold. First, the taping involves an extra step in the manufacturing of the staple roll. In addition, the tape tends to separate from the roll when the driving means drives a formed staple placed in a driving position and interfere with the driving mechanism, so that the staple hammaring operation may not be achieved.

U.S. Pat. No. 4,623,082 to Kurosawa discloses a stapler cartridge which feeds staples in sheets, rather than rolls, eliminating the need for tape in securing the staples together. While the Kurosawa invention has eliminated the problems associated with the use of tape in staple cartridges it is susceptible to periodic jamming of staple sheets in the staple sheet let-off opening. In addition, because of the large frictional forces on the guide member in the Kurosawa invention the staple sheet conveyor belt 7 does not convey the staple sheet with great reliability.

In order to illustrate the novelty and utility of the present invention the operation of the Kurosawa invention will be discussed in greater detail. Referring to FIG. 1(*a*) and FIG. 1(*b*) prior art, in order to feed a staple sheet S' from the cartridge A' to the forming and driving section of the stapler, the lowermost staple sheet Sa in the staple sheet accommodating section 1' is moved out through the staple sheet let-off opening 3' by means of a conveyor belt 7' . The staple sheet is held between the upper surface 7*a'* the conveyor belt 7*a'* of the conveyor belt 7' and the lower surface 13*b'* of a guide member 13', the frictional force between the conveyor belt and the staple sheet being utilized to transport the staple sheet. In order to prevent excessive frictional force between the guide member and the staple sheet the area of contact between the two is minimized. This is accomplished by providing a recess portion 13*c'* in the lower surface of the guide member so that only the edges of the staple sheet are in contact with the guide member 13'. The width of the conveyor belt is much smaller than that of the staple sheet and therefore the edges of the staple sheet are pushed downwards by the guide member and the middle of the staple sheet is pushed upwards by the conveyor belt. This imparts a curvature in the staple sheet as seen in FIG. 1(*b*). As a result, the area of contact between the conveyor belt and the staple sheet is minimized, as is the frictional force, causing the undesirable effect of inconsistent conveying of the staple sheet to the forming and driving section of the stapler.

Kurosawa provides for a magnetic means (not shown) placed directly below the conveyor belt 7' in order to alleviate the problem of insufficient contact between the conveyor belt 7' and the staple sheet S'. In order to cause a magnetic field of sufficient force the magnetic means must be as close to the conveyor belt 7' as possible, preferably in contact with it. Because the conveyor belt 7' is moving the resultant frictional force at the interface with the magnetic means causes premature wear of the conveyor belt 7'. Also, the magnetic means is limited in length in order to be disposed between the two pulleys of the conveyor belt 7'. Thus the magnetic means is not effective over the whole travel of the staple sheet S'. In summary, the magnetic means is undesirable because it is not entirely effective and it creates added expense in the manufacture, and maintenance in the operation, of the staple machine.

Referring now to FIG. 2(*a*) and FIG. 2(*b*) prior art, it is shown that the inside dimensions of the accommodating section 1' is larger than the staple sheets S' thereby creating a clearance C' between the inner wall of the cartridge and the stack of staple sheets. The cartridge is mounted so as to be inclined toward the rear wall 9' of the cartridge therefore allowing the vibration of the stapler to keep the staple sheets in contact with the rear wall. Under this condition, the lowermost staple sheet Sa' is conveyed by the conveyor. As the staple sheet Sa' is being conveyed through the let-off opening 3' the second staple sheet Sb' begins to contact the conveyor belt 7' and is pushed up against a sloped surface 3*a'* just above the let-off opening preventing the second staple from entering the let-off opening. As a result, the weight of the remaining staples in the stack acts as a shearing force on the front of the second staple sheet which is not in contact with the conveyor belt. This shearing force tends to bend the staple sheet Sb', as shown in FIG. 2(*b*), resulting in periodic jamming of the staple sheet in the let-off opening.

SUMMARY OF THE INVENTION

The objective of the present invention is to provide a staple cartridge for an electric stapler in which staple sheets stacked in the cartridge are conveyed smoothly and reliably to the forming and driving section of the stapler. This objective has been achieved by providing recesses in the corners of the staple accommodating section eliminating the possibility of jamming due to burrs on the corners of the staple sheet and providing a guide surface that maintains a flat profile of the staple sheet while gripping and conveying the sheet in a smooth consistent manner. The nature, principle and utility of the present invention will become apparent from the following detailed description of its operation and the accompanying drawings.

BRIEF DESCRIPTION OF THE DRAWINGS

FIG. 1(*b*) (prior art) is a sectional view taken along line y—y of FIG. 1(*a*);

FIG. 2(*b*) (prior art) is a sectional view of the staple sheet let-off opening in the prior art, illustrating bending of the staple sheet;

FIG. 3(*b*) is a sectional view of the present invention;

FIG. 3(*c*) is a sectional view taken along line x—x of FIG. 3(*b*);

FIG. 5 is an explanatory diagram for a description of the operation of the staple cartridge according to the present invention.

DETAILED DESCRIPTION OF THE PREFERRED EMBODIMENT

Figure 3A:
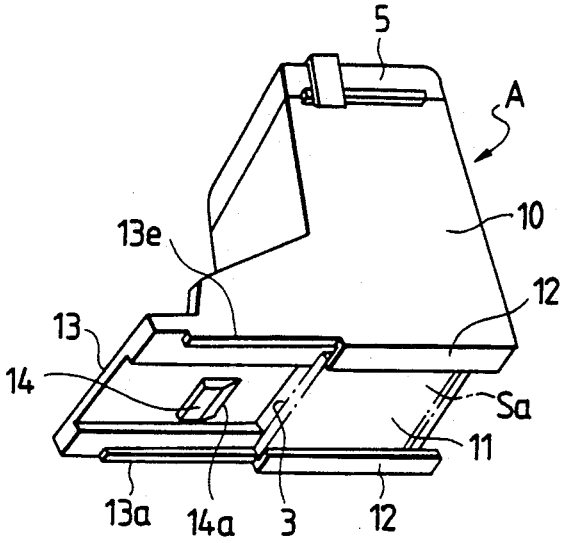
FIG. 3(*a*) is a perspective view of one embodiment of the present invention.
Figure 3B:
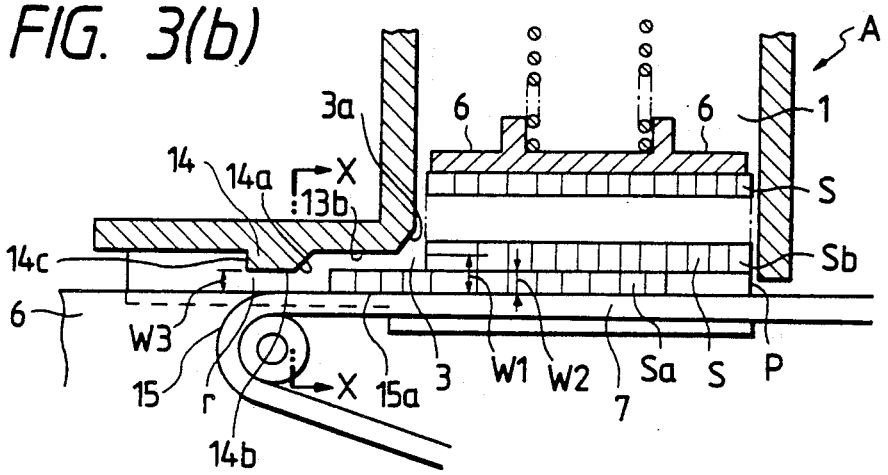
Figure 3C:
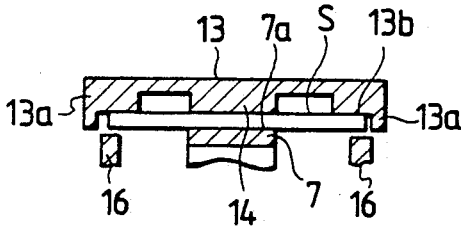

One preferred embodiment of the present invention will be described with reference to the accompanying drawings. Referring to FIGS. 3(*a*), 3(*b*) and 3(*c*), the staple cartridge A has a staple sheet accommodating section 1 in which a number of staple sheets S are stacked. The staple sheet accommodating section 1 has a staple sheet let-off opening 3 in the lower portion of the front wall 2 thereof, so that the staple sheets S are conveyed out of the accommodating section 1 through the let-off opening 3 one after another beginning with the lowermost staple sheet Sa. A depressing member 6 is connected to the cover 5 of the cartridge pushing down on the stack of staple sheets S. The lowermost staple sheet Sa is confronted with the staple let-off opening 3 and moved by a conveyor belt 7 through the staple sheet let-off opening 3. When the staple sheet is conveyed in this manner, the second staple sheet Sb is moved to the lowermost position by depressing member 6. In this manner, the staple sheets are successively moved downward and conveyed out of the accommodating section 1 through the let-off opening 3 into the forming and driving section of the stapler.

The cartridge A has side wall 10 and opening 11 in the bottom, and a pair of supporting members 12 are extended from both edges of the opening 11 so as to support both sides of the lowermost staple sheet Sa in such a manner that the front end of the lowermost staple sheet Sa confronts the staple sheet let-off opening 3. The upper portion of the let-off opening 3 is formed into a sloped surface 3*a* so as to facilitate movement of the lowermost staple sheet Sa into the let-off opening 3.

A guide member 13 is extended from the lower end of the front wall 2 towards the forming and driving section of the stapler and a pair of elongated guide projections 13*a* are formed along both edges of the lower surface of the guide member 13. A retaining protrusion 14 is formed at the center of the lower surface of the guide member 13 to retain the upper surface of the staple sheet S. The retaining protrusion 14 has a sloped guide surface 14*a* at the end facing the let-off opening 3.

The cartridge A is set on the magazine in such a manner that it is placed over the stapler sheet conveyor belt 7 in the stapler. In this position the retaining protrusion 14 of the guide member 13 is located above the conveyor belt 7. The gap W1 between the lower surface 13*b* of the guide member 13 and the upper surface 7*a* of the conveyor belt 7 is slightly larger than the thickness W2 of the staple sheet S. The gap W3 between the lower surface 14*b* of the retaining protrusion 14 and the upper surface 7*a* of the conveyor belt 7 is slightly smaller than the thickness W2 of the staple sheet S. Preferably, the width of the retaining protrusion 14 is equal to the width of the conveyor belt 7 and the front of the retaining protrusion 14 is located near the outer end of the conveyor belt 7.

In operation, with the cartridge A containing a stack of staple sheets S loaded on the stapler, the staple sheet conveyor belt 7 is driven. As a result, the lowermost staple sheet Sa is moved out of the accommodating section 1 through the let-off opening 3 and delivered to the forming and driving section while being supported by the staple guide rails 16 and being guided by the elongated guide protrusions 13*a* of the guide member 13 and the upper surface 7*a* of the conveyor belt 7. The lower surface of the lowermost staple sheet Sa is pushed against the upper surface 7*a* of the conveyor belt 7 by the forces of the stack weight and the depressing member 6. Therefore the staple sheet Sa is conveyed through the let-off opening 3 by the frictional force F at the conveyor and staple sheet interface. The staple sheet conveying is distributed evenly over the upper surface 7*a* of the conveyor belt 7 from the rear end p of the cartridge A to the front end r of the retaining protrusion 14. Since the gap W3 between the lower surface 14*b* of the retaining protrusion 14 and the upper surface 7*a* of the conveyor 7 is smaller than the thickness W2 of the staple sheet additional perpendicular force is applied, to the staple sheet S when it is below the retaining protrusion 14. The retaining protrusion 14 also serves to insure that the staple sheet S is held flat on the conveyor, thereby maximizing the area of contact between the staple sheet S and the conveyor belt 7. This additional perpendicular force and maximized area of contact serve to maximize the frictional force F, at the interface of the conveyor 7 and staple sheet S thereby providing a smooth positive delivery of the staple sheets S into the forming and driving section of the stapler without reliance on auxillary magnetic means.

Figure 4:
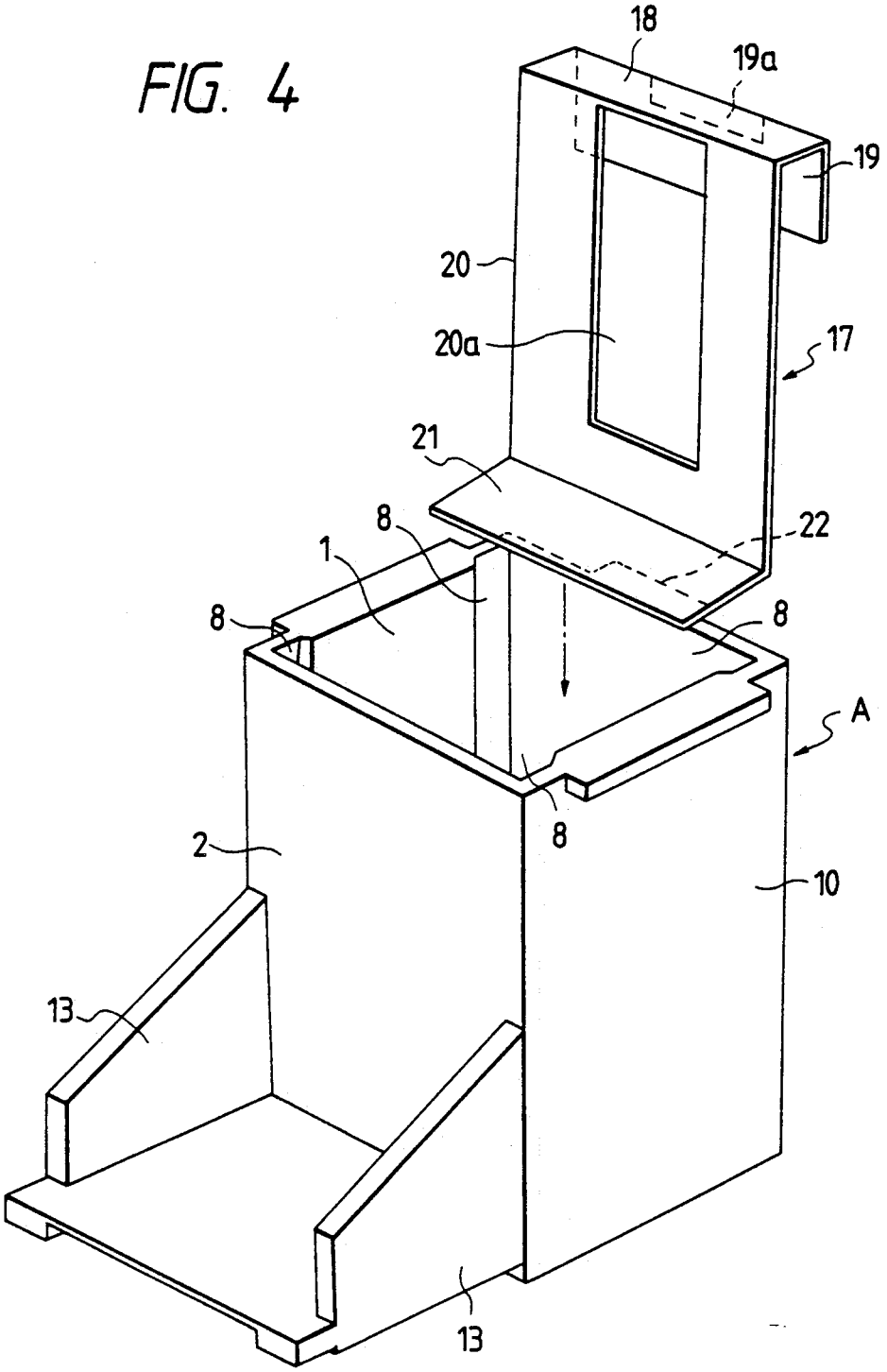
FIG. 4 is a perspective view showing the present invention complete with a feeding film.

Now with reference to FIG. 4 the staple sheet accommodating section has relief recesses 8 at the corners of the walls which extend vertically so as to prevent the corners of the staple sheets from coming into contact with the corners of the staple sheet accommodating section. Therefore burrs commonly found on the corners of the staple sheets will not prevent a smooth descent of the staple sheets to the bottom of the staple sheet accommodating section 1. Since the cartridge is usually inclined slightly to the rear in order to keep the staple sheets S in contact with the rear wall of the accommodating section 1, it is not necessary to place recesses at all four corners but only in the rear corners of the accommodating section 1.

A flexible feeding film 17, is suspended on the rear wall 9 of the cartridge A. The upper portion 18 of the feeding film 17 is folded over, thus providing a folded portion 19 U-shaped in cross section. An opening 20*a* is formed in the middle portion 20 of the feeding film 17. The lower portion of the feeding film 17 is bent at a right angle, thus providing a bent portion 21. The feeding film 17 is fitted in the cartridge A with the opening 19*a* engaging with a salient portion 22 on the outside of the rear wall of the cartridge A. The method of fitting the feeding film is not limited to the above, many other methods may be employed without departing from the spirit of the present invention.

The feeding film 17 is positioned in the cartridge A in such a manner such that the middle portion 20 of the feeding film 17 is placed between the stack of the staple sheets S and the rear wall 9 of the cartridge A, and the bent portion 21 is under the rear part of the lowermost staple sheet Sa. As described above the distance between the front and rear walls of the cartridge A is greater than the length of the staple sheets. Therefore vibration of the stapler maintains a clearance C between the front wall 2 of the cartridge A and the staple sheets S in the cartridge A.

Figure 1A:
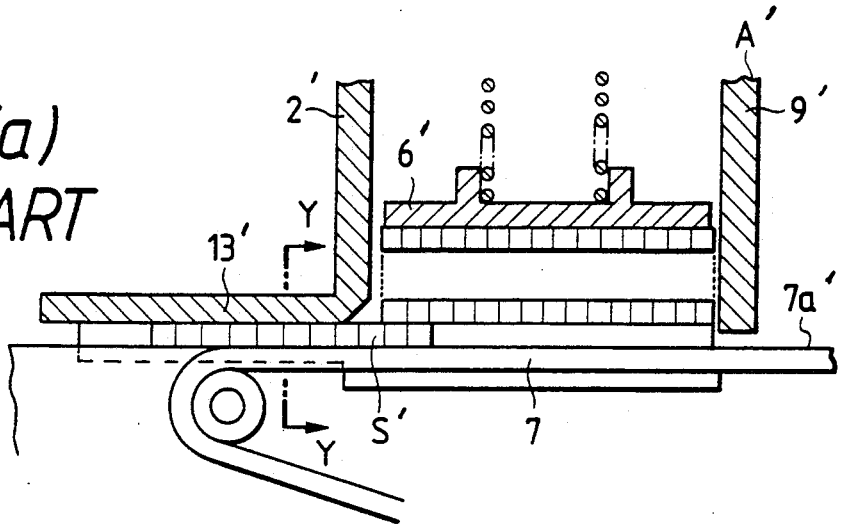
FIG. 1(a) PRIOR ART
FIG. 1(*a*) (prior art) is a sectional view of the prior art.
Figure 1B:
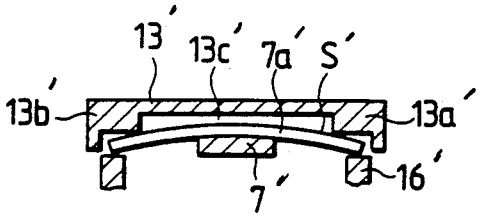
FIG. 1(b) PRIOR ART
Figure 2A:
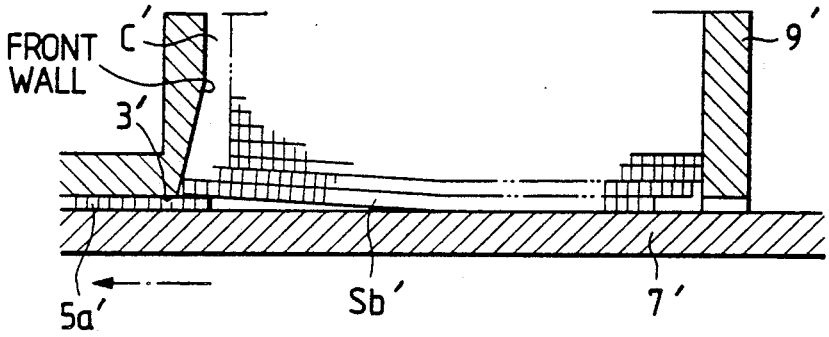
FIG. 2(a) PRIOR ART
FIG. 2(*a*) (prior art) is a sectional view of the staple sheet accommodating section of the prior art.
Figure 2B:
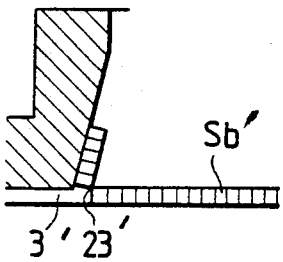
FIG. 2(b) PRIOR ART

As the frictional force exerted on the lowermost staple sheet Sa by the conveyor belt 7 conveys the lowermost staple sheet Sa into the let-off opening 3 it also tends to pull the bent portion 21 of the feeding film 17 forward bringing the staple sheets above the lowermost staple sheet Sa into contact with the sloped surface 3*a* above the let-off opening. Because subsequent staple sheets S are pulled forward with the second lowermost staple sheet Sb there is no resultant shearing force tending to bend the second lowermost staple sheet Sb as found in the prior art and illustrated in FIG. 2(*b*). This eliminates clogging of staple sheets S in the let-off opening 3 and permits the staple sheets S to be forwarded positively and smoothly, one after another, into the forming and driving section of the stapler.

While a preferred embodiment of the present invention is described above, it will be obvious to those skilled in the art that various modifications may be made therein without departing from the scope and spirit of the present invention.

We claim:

1. A staple sheet cartridge for dispensing staple sheets of predetermined thickness, adapted for use with a staple machine, having means on the staple machine for positioning said staple cartridge on the staple machine and a conveying means located at a predetermined position, comprising:

a staple sheet accommodating section comprising, a front wall wherein a staple sheet let-off opening is formed in the lower portion of said front wall so as to allow the staple sheets to exit from said accommodating section, two side walls having staple sheet supporting members extending along the lower edges of said side walls and at right angles to said walls so as to hold the staple sheets from exiting the open bottom of said accommodating section and, a rear wall, a guide member extending froward from the lower end of the outer surface of said front wall with a top portion covering the top of the staple sheet while in conveyance and guide surfaces for guiding the sides of the staple sheet along a staple sheet conveying means, and a retaining protrusion formed on a lower surface of said top portion of said guide member between said guide surfaces and directly opposite the predetermined position of the conveying means, in such a manner that when said cartridge is mounted on the staple machine the distance between the upper surface of the conveying means and the bottom of said retaining protrusion is less than, or equal to, said predetermined thickness.

2. A staple sheet cartridge as described in claim 1 wherein;

the staple sheet accommodating section has relief recesses at the rear corners of the accommodating section which extend vertically so as to prevent burrs on the corner of the staple sheets from contacting the rear corners of said accommodating section.

3. A staple sheet cartridge as described in claim 1 wherein;

the staple sheet accommodating section further has relief recesses at the front corners of the accommodating section which extend vertically so as to prevent burrs on the corner of the staple sheets from contacting the front corners of the accommodating section.

4. A staple sheet cartridge as described in claim 1 wherein;

said front wall is constructed so as to have a sloped surface formed on the interior side just above said let-off opening and sloping into said let-off opening.

5. A staple sheet cartridge as described in claim 1 which further comprises a feeding film having its lower portion adapted to be placed between the lowermost of the staple sheets and the top surface of the conveying means, its middle portion placed between the staple sheets and said rear wall of said accommodating section, and its upper portion engaged with part of said accommodating section.

6. A staple sheet cartridge as described in claim 1 further comprising a depressing member in said accommodating section placed so as to urge the staple sheets to the bottom of said accommodating section.

* * * * *